US007336178B2

(12) United States Patent
Le

(10) Patent No.: US 7,336,178 B2
(45) Date of Patent: Feb. 26, 2008

(54) METHOD AND APPARATUS FOR REMOTE CONTROL VEHICLE IDENTIFICATION

(76) Inventor: Michael Q. Le, 27572 Kathy Ct., Laguna Niguel, CA (US) 92677

( * ) Notice: Subject to any disclaimer, the term of this patent is extended or adjusted under 35 U.S.C. 154(b) by 305 days.

(21) Appl. No.: 11/231,728

(22) Filed: Sep. 20, 2005

(65) Prior Publication Data

US 2006/0087427 A1 Apr. 27, 2006

Related U.S. Application Data

(63) Continuation-in-part of application No. 11/053,311, filed on Feb. 7, 2005.

(60) Provisional application No. 60/617,248, filed on Oct. 7, 2004.

(51) Int. Cl.
*G08B 13/14* (2006.01)

(52) U.S. Cl. ..... 340/572.1; 340/10.1; 340/539.13

(58) Field of Classification Search ..... 340/572.1
See application file for complete search history.

(56) References Cited

U.S. PATENT DOCUMENTS 3,546,696 A 12/1970 Waters et al.
3,714,649 A 1/1973 Brouwer et al.
4,325,146 A 4/1982 Lennington
4,449,114 A 5/1984 Fascenda et al.
4,823,367 A 4/1989 Kreutzfeld
4,857,886 A 8/1989 Crews
5,090,030 A 2/1992 Jenkins
5,194,843 A 3/1993 Jones et al.
5,666,101 A 9/1997 Cazzani et al.
6,380,863 B1 4/2002 Swoboda et al.
7,228,228 B2 * 6/2007 Bartlett et al. ..... 701/207
2003/0016135 A1 * 1/2003 Dowd ..... 340/573.3

* cited by examiner

*Primary Examiner*—George Bugg
(74) *Attorney, Agent, or Firm*—Donn K. Harris

(57) ABSTRACT

An apparatus and method for automatically tracking each individual vehicle, of a plurality of vehicles, in a race around a track. The device employs RFID tags on each of the vehicles being tracked and at gates adapted to cause the RFID to energize and broadcast the vehicle's identity when a pass through the gate is determined. Collisions of data transmission and resulting loss of identification data are reduced through commands to RFIDs responding and remedied with an inventory command based on most likely respondents. The device can be employed to both track the individual vehicle participants in a race and also to register the participants in the race. Races can be tracked on different courses in different geographic locations by placing the RFID tags on all participants and tracking their progress on the individual remote tracks from a central location.

25 Claims, 2 Drawing Sheets

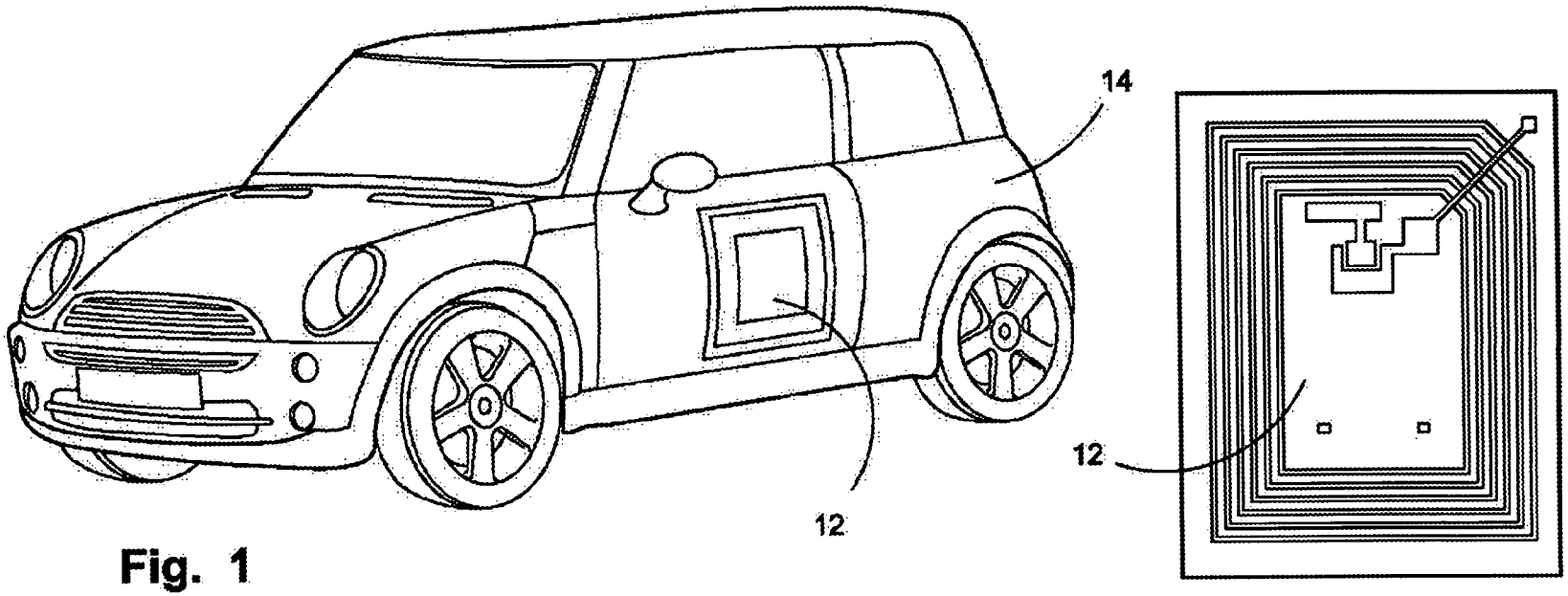
Fig. 1
Fig. 2
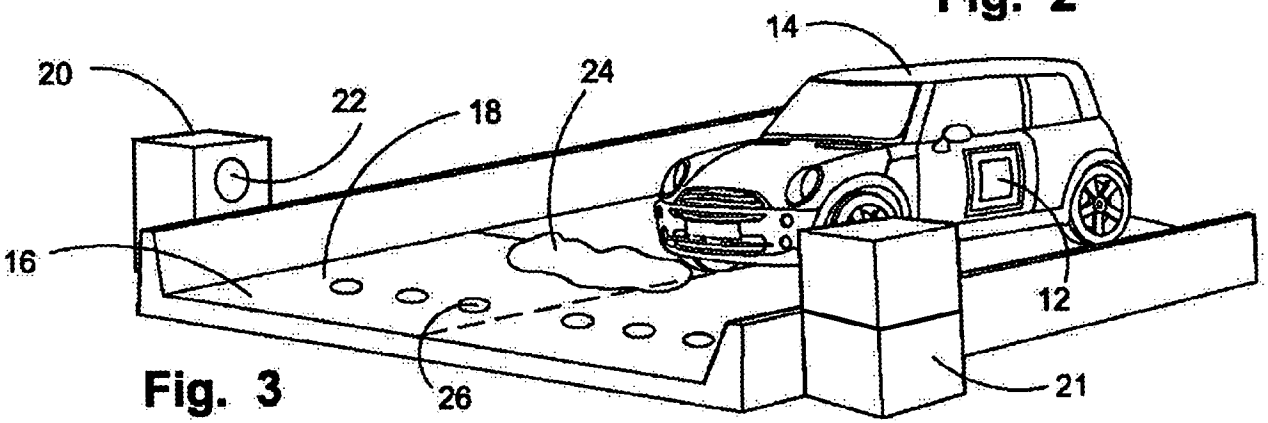
Fig. 3

METHOD AND APPARATUS FOR REMOTE CONTROL VEHICLE IDENTIFICATION

This application is a Continuation-in-Part Application from U.S. patent application Ser. No. 11,053,311 filed on Feb. 7, 2005 and currently pending which claims benefit to U.S. Provisional 60/617,248 filed on Oct. 7, 2004.

BACKGROUND OF THE INVENTION

1. Field of the Invention

The present invention relates to vehicle racing. More particularly the device herein disclosed relates to a method and apparatus for the identification and tracking of vehicles used to race upon a defined track.

2. Prior Art

The racing of vehicles has been a popular sport since the dawn of the motor vehicle itself. Such races generally pit a plurality of vehicles against each other to complete a defined distance around a defined track in the fastest amount of time. As a general rule, the distance is a multiple of individual lengths or laps around a track of a determined length.

A vexing problem for such racing which has also been around since racing first began is the tracking of the vehicles in the race. This is because in order to determine which vehicle in the race has finished the defined distance first or in the shortest amount of time, the total number of laps must be computed as well as the total aggregate time it took the vehicle to complete the defined distance of the race.

In the early days, spotters actually watched the cars go past the starting line and counted the number of laps completed. This system was obviously prone to human error and cheating.

In recent years, with the advent of technologies to handle the task, a number of systems have been employed to track the vehicles in the race. There are four detection methods currently used on the market for lap counting.

A first such system involves the use of lasers and has been used primarily in model or slot car racing. This system employs a beam that is projected across the track at the finish line to a receiving device that senses the laser beam striking it. When a car crosses the laser beam, it blocks the laser light from hitting a sensor on the opposite side of the track and "counts" the crossing. The detector then communicates to a counter or computer that the beam has been broken which registers the crossing of a vehicle. Since slot car racers employ individual tracks or lanes for each racing vehicle, multiple lasers can be set up across each lane, or can be set at different heights to monitor more than one car at a time. If multiple cars are used, a flag must be attached to the antenna of each car (to block the laser light) at different heights corresponding to the height of each laser. However, this system has an inherent problem in that only a limited number of cars can be run at the same time because of the spacing required for the lanes and the length of the antenna. Another drawback to this system is that the laser poses a potential hazard to the users.

Another timing system by Lapz uses infrared transmitters and receivers. When a car passes underneath a structure that holds the infrared receivers, the receivers will detect the presence of infrared light emitted from a transponder that is connected to the vehicle. However, a problem with this system is that the transponder must be mounted on the car with a direct line of sight to the receivers which may be difficult in some vehicles. Additionally, because infrared detection is used, the background light radiation (since light produces infrared waves) can degrade the performance of the system. The transponders also require power from the vehicle to which they are mounted and are relatively large. This precludes the use of this system in small scale vehicles such as the 1/64 scale ZipZaps which have small capacity batteries that cannot tolerate the extra power drain nor the extra weight of the transponder.

A third detection system for model or slot car racing from AMB also involves the use of a battery powered transponder device on each car. It has the same drawbacks relating to the size of the transponder as the previous system and the current draw which can slow the car or decrease its range.

In this system which is the standard system used by professional events such as NASCAR a wire pickup is placed underneath the track. When the car passes over the wire, the transponder's continuously broadcasting signal, broadcast on a specific frequency, is picked up by the wire and then processed by a receiver unit.

The communication is only one way in this system in that the transponder continuously emits its signal at the designated frequency allotted to the individual car, and the sensor pickup system is only used to receive the emitted signal. It is, of course, not well adapted to small battery powered or model racing due to the continuous current draw of the transceiver. Further, the required separation of frequencies on the radio band used, limits the number of participants that can be tracked.

A fourth detection system from KoPropo detects the unique frequency that each radio-controlled vehicle produces. Each car uses a different frequency to allow multiple cars to be raced at a time. This system detects the unique frequency produced by a transmitter or by the motor in each vehicle. A piece of wire is put underneath the track to detect the individual frequency of each car that passes over it. Thus, the system requires no transponders if the unique motor RF transmission is tracked. However, this system can only detect a certain number of limited frequencies. The system must be customized or redesigned if the user wants to use a car that operates on a different frequency than the ones that come with the system.

In addition to the problems related to limited participant number and power drain, none of the systems noted above provide a means to remotely identify the vehicle being tracked. At best, each individual car is assigned some sort of identifier for the race which is broadcast when it passes the starting line or some other monitoring point. The identification is good for the individual race only and changes with each race. Consequently, the race participants must go through the time consuming process of registering at each race event for each race around the given track. Because each individual track has their own identifiers, it precludes having remote races with remote participants competing around different tracks since there is no common manner to identify the cars on the tracks.

SUMMARY OF THE INVENTION

The device and method herein disclosed provides timing, aggregate distance tracking, and universal identification of race cars participating in a race or participants in any type of race with one or more venues running a concurrent race. The device stores information about each participant onboard the racing vehicle by employing a tag with stable memory or optically readable bar codes encoded with information about the vehicle and its owner.

The preferred embodiment employs a tag or label with onboard memory such as an RFID tag to hold participant information. RFID stands for Radio Frequency Identification. It is also referred to as EID or electronic identification. An RFID tag consists of a microchip or similar memory means to store data and execute software commands which is attached or communicates with an antenna that broadcasts data information a finite distance.

RFID tags are developed using a radio frequency according to the needs of the system including read range and the environment in which the tag will be read. RFID tags may be active and use small amounts of onboard or available electrical power or in the current favored mode they can be passive, meaning they do not require a battery for operation. Such passive RFID tags require no power to operate in that they are energized by a reader when placed sufficiently close to it using a magnetic field that generates current in the tag for a concurrent broadcast from the tag. Active RFID tags, on the other hand, must have a power source and may have longer ranges and larger memories than passive tags as well as the ability to store additional information sent by the transceiver. Passive tags have an unlimited life span since they have no battery or power which might degrade over time. At present, the smallest active tags are about the size of a coin. Many active tags have practical ranges of tens of meters and a battery life of up to several years so they might also be used where weight is not an issue.

Each RFID tag can be visually read or electronically read with a remote RFID reader enabling the transfer of information programmed into the memory of the RFID. This information might be as simple as an identifier such as a number or arrangement of letters, of the RFID itself, which may be associated with the car and owner by a relational database. Or, the RFID may be encoded with more information which is held in programable memory which might include information about the specific car on which it is mounted, its owner, and other relevant stored information to be transmitted quickly and accurately.

RFID technology eliminates the need for "line of sight" reading. The tags can be mounted on the exterior of the cars or internally since RFID communication easily penetrates through wood, plastic, and even thin metal. Currently, there are four different kinds of tags commonly in use, their differences based on the level of their radio frequency: Low frequency tags (between 125 to 134 kilohertz), High frequency tags (13.56 megahertz), UHF tags (868 to 956 megahertz), and Microwave tags (2.45 gigahertz). However, frequencies can be any allowed by the FCC.

In use the RFID tag with its onboard memory would be programed, preferably by a central authority for that racing circuit. In the case of slot car and model racing, the association or authority which sponsors the different regional races would receive information about the entrant and program the RFID with data to identify it during one or more future races. Such information can be a simple unique identifier or can include information about the car, its owner, and any other relevant information desired. This information unique to the individual RFID would be programed into a specific RFID tag which would be given to the car owner for mounting on the car.

Where entrant and car information is programed in such a pre-registration scheme there can be two purposes. First, when the car is racing, the RFID tag will broadcast the onboard data or information enabling the race officials to easily gather information about the times and distances traveled by the various racers participating. Second, by programming all of the owner and/or car and/or other desired participant information into the individual RFID components in a standardized fashion, registering for each race will be as simple as placing the participant's car close enough to a tag reader to energize the tag which will simply transmit the information to a computer tracking the participants. No forms or other writing would be required for the participants to enter.

In use during a race, a sensing or trigger means such as one which would sense when individual cars cross a point on the track such as the finish line would be employed. This can be done using light beams or proximity detectors or other means to sense the movement of a car past a designated point, so long as relatively accurate location of the car on the track is achieved. When a crossing of the gate or point being monitored is sensed, a trigger means activates the RFID to transmit information. In the case of a passive RFID, passing through an energized field can be the trigger means since the RFID itself would move from a dormant state to an energized state, causing it to process and transmit its encoded data. Each time the car passes the point being monitored and the RFID is triggered, the identification information is automatically transmitted or transmitted subsequent to an inventory request from the receiver or reader. If the RFID is active, then a small receiver can also be employed on the car to sense the passing of the point and activate the RFID to transmit identification information to the receiver or reader adapted to receive the communicated information and pass it on to a computer.

The gate might also be a directional RF signal sufficient to energize a passive RFID with a short distance of transmission broadcast from the proximity of monitoring point. The signal would be continuous and since the RFID tags only broadcast their programmed identification information when they become energized by the signal, they would only report the car when it passed into the point of the continuous energizing broadcast.

At a location either adjacent to the track or remote from the track, depending on the strength of the signal generated by the broadcasting RFIDs on the participants, a computer would keep track of the participants' progress in the race. Since the system is not dependant on parsing out a narrow radio spectrum to participants, nor is it dependent on the physical aspects of the track limiting visual aspects like other systems, the number of participants that can be concurrently tracked is infinite. Further, the system would allow for "virtual races" to be held at different locations by employing identical tracks for participants to race upon, all with tag readers to track the participants and communicate the times and distances of the remotely located participants to a central tracking station. In this fashion a race could be held concurrently in New York and Los Angeles using cars equipped with the identification tags all racing on identical tracks. An unlimited number of tracks and cars can be monitored since the tags are individual to each participant and can be tracked concurrently irrespective of the amount of radio spectrum available.

When multiple cars in the race pass through by a gate substantially simultaneously and their respective RFIDs are triggered to transmit, the plurality of responding RFID transmissions can overlap causing a problem identifying the responding cars respective RFIDs. This is because the receiver or reader of the broadcast RFID information is unable to decipher radio wave transmissions reflected back by two or more RFID tags activated to transmit substantially due to the collision of transmissions.

Conventionally employed anti-collision protocols to enable the reader to communicate with one RFID at a time in rapid sequence have been found to be lacking in a racing environment. This is because unlike a shopping cart, which in a static position can sit near a reader or gate for extended periods, racing cars are in the proximity of the gate or reader for very small or finite periods of time. These conventionally employed systems depend on as much time as is necessary to allow the reader and the RFIDs to sort out the problem using a number of time-consuming methods. Used in a fast paced race with small finite times of proximity of the cars to the RFID readers, there is a substantial risk of losing track of or missing a participant during a lap.

In a typical RFID system where there is a chance multiple RFID tags may be in the reading range of the antenna, the reader will use a multi-slot inventory request. Because there are multiple time slots for the tags to respond, the likelihood of a collision (where two or more tags respond in the same time slot) is reduced. However, this method is not well suited for race cars because it takes too much time to wait for a response in each of the 16 or more time slots. A car might happen to pass the antenna loop completely and not respond because the inventory command was not heard since the reader must wait multiple time slots before issuing another inventory request. Remember, tags only respond after a request is made.

The device and method herein solves the problem through the employment of a system to sort out collisions of data from RFIDs which only linger in the transmission area for a short period of time. The device and method herein employs a unique means to avoid collisions of RFID data transmission which employs a single time-slot inventory request and additionally instructs responding RFIDs to be silent once they respond during each passage through the reading area adjacent to the gate 18.

Instead of using a multiple time slot format or ordered response format, both of which can lose data, the device herein in a particularly preferred mode would provide only one time slot for responses to all inventory requests of all of the RFID transmitters energized and looking to transmit in response to such requests. This limits the potential for collisions of data and the potential that a participant might pass the gate being monitored before responding. Also, responding RFIDs are instructed to be silent to the next inventory request received.

If a collision is detected, an extra step is employed to sort out the responding RFIDs transmissions through the employment of an algorithm that seeks to sort the respondents transmissions based on the most likely RFID not to be in the group. The algorithm is based on tracking responding identifications of each RFID and continually placing the latest responding RFID at the end of a sequential list of possible responding RFIDs in a substitute list. If a collision is detected, the system will change the normally transmitted open inventory request for responses to the substitute list where the RFIDs are commanded to respond in the order of the substitute list. Since the latest tracked RFID is last on the substitute list, only the most likely responders are instructed to transmit in order, thereby increasing the time for response by decreasing potential responders.

The algorithm reduces the likelihood that a car or race participant can whiz by the antenna loop and not hear an inventory request (because the number of time slots the issuer must wait before issuing another request). The drawback with one time slot or using very few time slots is that it might result in more collisions since there is only one time slot for all the tags to respond. The algorithm or another electronic or mechanical means to ascertain the most likely car not to be responding, is employed to solve that dilemma by querying only the most likely cars to be passing the antenna loop next when a collision occurs (to determine the id's of the two or more tags that just produced the collision). This saves time because time is not wasted trying to communicate with the RFID tag on a car that has a low probability of being in the antenna loop during that time instant.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Also, while the description above describes the use of the system in a fast paced automotive race, the device and system could also be employed in any race where there are a plurality of participants such as a running race or a NASCAR race or any other race. It would be especially useful for such races of participants which are run concurrently on different tracks at different geographic locations to track all of the individual participants and to determine a winner. The system is also adapted to handle the problems inherent to tracking fast moving objects in close proximity to each other and the tracking points and to increase steps taken to avoid loss of tracking depending on the relative problems encountered. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

An object of this invention is to provide a device and method to passively track participants in a vehicle race.

Another object of this invention is the provision of a device and method to track such participants in model car races.

A further object of this invention is providing a device and method to register participants in races without the need for paper or writing by programming the relevant information into a tag on the car being raced.

An additional object of this invention is the provision of such a car tracking device that will allow for unlimited concurrent participants irrespective of the radio frequency used for monitoring.

Yet an additional object of this invention is the provision of such a car tracking and monitoring device and method that will allow for concurrent races between entrants at different geographic locations on similar tracks.

A still further object of this invention, is the provision of such an RFID system for tracking cars in a race which provides methods for avoiding most broadcast conflicts from close proximity RFIDs on cars in close proximity.

Yet another object of this invention is the provision of such an RFID system for tracking cars in a race which provides methods to remedy RFID broadcast conflicts if detected.

Further objects of the invention will be brought out in the following part of the specification, wherein detailed description is for the purpose of fully disclosing the invention without placing limitations thereon.

BRIEF DESCRIPTION OF DRAWING FIGURES

FIG. 1 is a perspective view of the device showing an RFID tag on a car.

FIG. 2 depicts RFID tags in decal or adhesive-backed form ready for application to a car.

FIG. 3 shows a side perspective view of the monitoring point on a track which activates transmission of the RFID.

DETAILED DESCRIPTION OF THE PREFERRED EMBODIMENTS OF THE INVENTION

Figure 4:
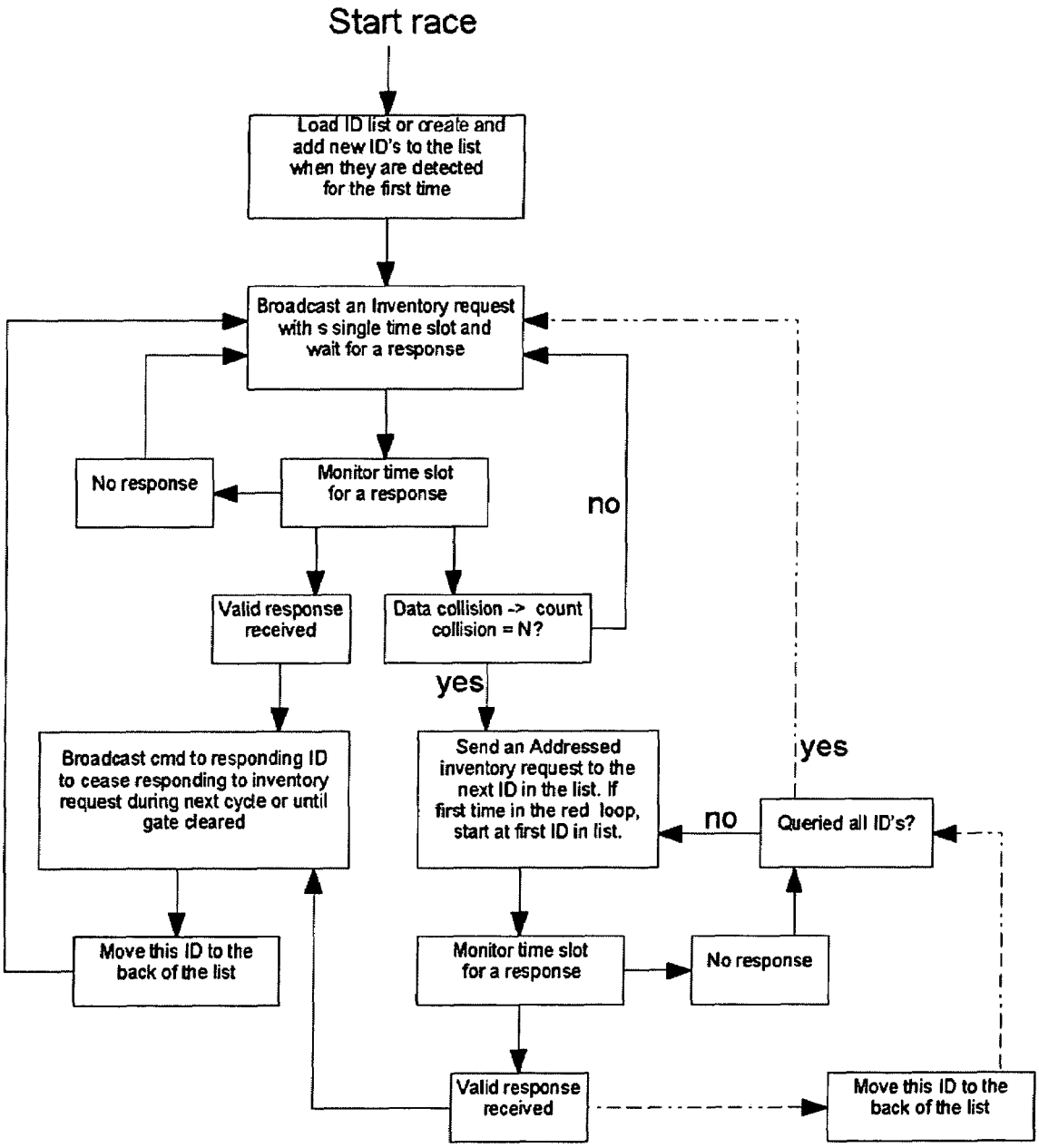
FIG. 4 is a diagram of the operation of the system employing first and second means to avoid data collisions and remedy occurring data collisions.

Referring now to the drawings, FIGS. 1-4 depict the components of the device and system employed for remote control vehicle identification and tracking. These components may also be used in the registration system for race participants on a local or national scale. In addition to tracking the entrants in a race around a single race track, the device and system may also be used to track the individual racers and cars at a plurality of venues having substantially identical tracks. Essentially, using substantially identical or equal distance racetracks located at remote venues, the racers could race against each other and the system would track the progress of the various entrants around the various tracks to determine the winners.

In use the RFID tag 12 would have an onboard memory capability employing a microchip or other memory storage device which uses either programable memory or read only memory that would be programed with the car's identity along with the owner and any other pertinent information needed to track the car during the course of races it might enter. The RFID tag 12 and data in its memory would then be affixed to the car at an operable location to be energized. A programable memory scheme would work best for remote registration of the entrants since a wand or other broadcast type programmer could input the pertinent information into the RFID tag 12. Of course the RFID tag 12 might also just broadcast a number or identification strand of information that can be cross-referenced to a data base of the specific information about each participant that is stored in a central database and received when the RFID tag 12 is assigned to that participant.

In the case of slot car and model racing, the association or authority which sponsors the different regional races would receive the information about the car, its owner, the other relevant information during a registration process and would program that information into, or associate it with, a specific RFID tag 12 which would be given to the car owner for mounting on the specific car 14 to be raced.

In use, a trigger to determine passage can be employed in the form of a sensing means such as a light beam 22 that would be broken by a car 14, a buried wire loop 24 that would sense passage overhead, or buried light projectors 26 which would sense a passing car 14. Or, the RF or EMF transmitters 20 at the gate 18 providing a means to energize a passive RFID 12 could be the simple means to trigger signal of passing through the gate 18 by simply energizing of the RFID 12, causing it to transmit onboard identification data stored in memory. Or a combination of the above means to trigger a signal that the car 14 has passed the gate 18 could be used. Further, as those skilled in the art will no doubt realize, other means to trigger a signal that the car 14 has passed a gate 18 or point on the track being measured could be used and such are anticipated to determine when individual cars or participants in any other type of race cross a point on the track such as the finish line. Therefore, determining the crossing of a point on the track can be done using light beams or proximity detectors or RF or other means for triggering a pass through the gate so long as relatively accurate location of each car 14 on the track 16 is achieved.

When a crossing of the gate 18 or point being monitored is sensed, the RFID 12, in the case of a passive RFID, would be energized causing it to subsequently identify itself by transmitting its stored identification relative to that individual RFID 12 on that individual vehicle. This data in an RF transmission from the RFID 12 is communicated to a receiver or reader 21 on the appropriate frequency and at an appropriate distance from the car to receive and process the transmission.

Each time the car passes any gate 18 or point on the track being monitored, and a means to initiate the RFID to broadcast provides the trigger to do so, the information programmed into or associated with that individual RFID 12 is automatically transmitted to a receiver. This means to trigger the RFID to broadcast as noted can be provided passively by energizing the RFID when a means to energize the RFID is located adjacent to the gate 18 and initiates communication, or by receipt of an inventory request from a reader in communication with the gate 18 being passed by an energized RFID that is triggered. If the RFID 12 is active and has onboard electrical power, then a small receiving device on the car in communication with the RFID 12 can also sense the passing of the point and provide a trigger to the RFID and initiate communication by the RFID 12 to transmit its data automatically or in most cases subsequent to an inventory request for its identification from a reader.

Of course, if the RFID 12 is passive, the appropriate energy field would be concurrently formed adjacent to the RFID 12 near the gate 18 being passed to provide energy for operation of the RFID 12 and transmission by energizing of the RFID 12 while in the field automatically or subsequent to an inventory request from the reader. Subsequent transmission of onboard information associated with the individual car 14 to which the RFID 12 is affixed would occur while the passive RFID 12 was in the energy field. Both types of RFIDs generally include a small data processor for executing software for commands and responses to commands from the reader 21 which receives the information transmitted by the RFID 12. Data format transmitted from an active RFID 12 would, of course, be the same or similar to the data from a passive RFID 12 once communication is initiated.

The gate 18 might also provide a trigger to the RFID in the form of a directional signal with a short distance of transmission broadcast at the point of monitoring. One or a plurality of RF transmitters 20 would energize the area around the gate 18 providing a continuous source of energy to energize the passing RFID 12 which is in proximity to the gate 18. Since the RFID tags only broadcast the programmed information when they are triggered to do so by the receipt of the energizing signal and/or an inventory request from a reader, they would only report identification information of the car 14 when it passed through or over the point of the continuous broadcast adjacent to the gate 18 tracking cars therethrough.

Because auto racing tends to have very close outcomes and proximity of the participants, in a preferred mode of the device it may be advantageous to employ some sort of light beam in the lanes of the individual cars, as noted above, in case two cars 14 pass through the gate 18 in close proximity as a means to determine the relative positions of the cars 14 in adjacent lanes on the track and alternatively act as a trigger to initiate an inventory request from the cars in proximity to the gate 18. Other means to enhance the ability to ascertain relative positions of closely proximate cars 14 such as means to avoid data transmission collisions and anti-collision algorithms or similar anti-collision avoidance methods noted below can also be employed for this purpose singularly or in combination with the light beam.

As noted above, at a location either adjacent to the track 16 or remote from the track 16, depending on the strength of the signal generated by the broadcasting RFID 12, a computer communicating with a reader 21 of RFID transmitted information from the broadcasting RFIDs 12 would keep track of the individual participants' progress in the race based on the identification information received from the RFIDs 12 which individually identify each participant. An unlimited number of tracks and cars can be monitored at an unlimited number of locations since the RFID 12 tags each broadcast identification information which is individual as to the identification of each individual participant. In the preferred mode of the device to track auto racing, with the inclusion of RFID broadcast anti-collision technology for racing, developed for this purpose and herein disclosed, all participants in a multi-car, multi-lane race can all be tracked concurrently, irrespective of the bandwidth of radio spectrum available and data collisions.

Using the components of the tracking system thereby provides a method to track each of the individual participants in a race, and they may be concurrently employed to register the participants in one or more races on the circuit during one or more racing seasons. The system, as noted, significantly enlarges the potential racing venue through networking of the tracking of the cars 14 in various races, thereby providing the ability to track multiple cars 14 at multiple geographic venues with similar or identical tracks to thereby have races concurrently between many participants in many different locations around the globe.

The device may be used in conjunction with a method of registration using the steps of programming all of the owners and cars and any other required information into the RFID 12 in a standardized fashion, employing an RFID reader 21 that reads the RFID-transmitted programmed RFID identification information at each race site, communicating the read information to a computer and recording the registrants and individual cars for the individual race based on the individual identification information stored in and broadcast by the RFID. This can be done by simply passing the cars 14 through a gate or other point that will provide a means to trigger the RFID 12 to transmit its programmed data. This can be done prior to the race, or actually during the race to eliminate pre-registration. Standardizing the data format into appropriate fields of information will eliminate paper and writing to register the participants. Further, as noted, the number of participants in a race or series of races is no longer limited by the track at a single location since multiple similar tracks at multiple venues, each with RFID enabled cars 14, can be networked.

Once registered, the device and system can be employed to track the cars 14 or participants in a race on one or a plurality of race tracks. The above steps would be used to register the entrants by associating broadcast identification data from the RFIDs 12 on each car 14 with that specific car. Then the cars may be tracked in each race by the additional step of monitoring the participant cars during the term of the race for passing through a gate 18 and the step of adding the aggregate number of passes through the gate 18 to determine the winner based on distance traveled and/or aggregate time of the travel of the individual cars being tracked over the determined race track course.

As noted, races between participants could occur at one or a plurality of venues with the same or similar tracks and the data of cars 14 passing through gates 18 similarly situated on the similar tracks would be fed through a network to a central computer which would employ software to track all the participants over the course of the race. If the race were only at one track, the network would not be necessary since the tracked cars 14 would be on site.

As indicated above, when multiple cars 14 in the race pass through a gate 18 simultaneously or very close in real time and their respective RFIDs are triggered to transmit identification information, if an unaddressed inventory request to the RFID proximate to the gate 18 is transmitted and received by multiple RFIDs, the plurality of responding RFID transmissions can overlap, thereby causing a problem identifying both cars 14. In the case of RFID transmissions, the RFID readers 21 as a general rule can't read more than one RFID transmission during a given time period. This is because the reader 21 is unable to decipher radio wave transmissions reflected back by two RFID tags activated to transmit substantially at the same time when they reach the gate 18 in close proximity since the simultaneous transmissions from one or more cars 14 in close proximity will cause a collision of transmitted data.

Manufacturers of such devices have developed anti-collision protocols to enable the reader to communicate with one tag at a time in rapid sequence. The most common anti-collision schemes are called "aloha" and "tree walking."

Aloha assigns each RFID a time slot to talk to the reader. The multiple time slots for transmission are essentially designated periods of time, say 5 milliseconds, during which all RFID transponders within range of the reader are requested to transmit their data in their assigned time slot. In a typical multi-time slot request, transponders can respond to the inventory request in, for example, sixteen allocated time slots. The RFID reader in such a case would transmit instructions to each RFID to respond in a specific time slot based on the identification number of the RFID or other defined parameters. Since the broadcasting RFIDs can respond at different time slots, the chance that a collision occurs is low.

However, a big drawback to a multi-slot inventory request has been found since this scheme is very slow in relative terms because the racing cars 14 are moving very quickly and since the reader waits sixteen time slots before issuing another inventory request from passing RFIDs. The sequence in time would look like this: inventory_request–>slot 1–>slot 2–>slot 3–> . . . –>slot 16. If a car happens to whiz by the gate 20 during slots 1-16, it will not respond since it was not present when the initial inventory request was made by the reader. It has been found that this can result in a missed lap where the car 14 that sped past the gate 18 was not detected properly as it left the reading area before initiating a broadcast from the RFID.

With the tree walking mode used by industry to avoid collisions, the reader requests the RFID tags to speak in sequence: first all of the tags with serial numbers that start with 0, then 1, then 00 and 01, then 10 and 11 and so on. The tree-walking scheme is similar to a teacher asking only the students whose names begin with "A" to answer, instead of having all the students shout out their names at once. However, because of the high speed of the cars on the track and their limited time sufficiently close to the gate 18 for the reader 21 to receive the inventory request, there can be a high likelihood that a responding RFID on a car 14 at the middle or end of the authorized response sequence transmitted to the RFIDs on the cars, can respond when out of range of the gate 18 and could miss being counted.

To solve the problem of collisions of identification data transmitted by the RFIDs in the high speed, short read time of a racing environment, through experimentation the system herein provides for first and second means to avoid data collisions. This is accomplished by a unique method of inventorying the RFIDs on the respective cars in a high speed race to elicit their response without data collision or loss of responses from individual RFIDs which only linger in the transmission area for a short period of time. In a first means to avoid data collisions, the method herein employs a single time slot inventory request instead of the conventional multiple time slot request and, additionally, instructs any responding RFIDs on the cars 14 to be silent on the next subsequent inventory request broadcast received after a completion of their individual data transmission during each passage through the reading area adjacent to the gate 18.

Instead of using a multiple time slot format or ordered response format, both of which can lose data, the disclosed method herein in a particularly preferred mode would employ only one time slot for response to all inventory requests of all of the RFID transmitters energized and looking to transmit in response to such requests. Of course those skilled in the art will realize that by adjusting timing and time slots and including the command to be silent other means to avoid collisions might be developed; however, the current best mode found through experimentation shows that employment of a single time slot for the elicited response and an order to silence the responding RFID works best.

In this first means configured to avoid missed rehouses and avoid data collisions which employs a single time slot, the inventory request sequence broadcast to proximate RFIDs in time would look like this: inventory_request–>slot 1–>inventory_request–>slot1–> . . . and so on. Then, to further reduce the chance of a collision of data transmitted by two cars 14 in close proximity, after the RFID on a car 14 transmits its response to the inventory request, the RFID on that responding car 14 is commanded to cease responses to inventory requests during that individual response cycle adjacent to that gate 18. A second car 14 following the first to reach the proximity of the gate 18 which then initiates an inventory request will then have its RFID transmit onboard data and also be commanded to cease responses during that cycle through the reader 21. The same cycle of response and silence is provided to each RFID responding adjacent to each gate 18. This first step of allowing one time slot and ordering response cessation helps to greatly limit collisions of data from RFIDs on cars 14 in closed proximity to each other and a gate 18.

If two or more RFID transponders broadcast their identification information near the gate 18 in close proximity or at substantially the same time, even employing the above steps, there exists a potential for a data collision during the one time slot, even with the instruction for the first responder to cease transmitting. As such, if a collision of data is detected by the receipt of garbled or unreadably transmissions by the reader 21, the device herein employs a second step as a second means to avoid data collisions through employment of an algorithmic function which directly affects the order of the inventory request broadcast to the RFIDs for the next cycle. This collision loop is shown on FIG. 4 where "N" is detected number of collisions with N being more than zero for garbled information received in response to an inventory request. The number of detected collisions may be one or more to start this collision loop of the system wherein the collision algorithm is employed to immediately sort out and remedy the problem encountered. This algorithm developed for inventorying RFID identification of individual participants in a race intelligently manages the collisions of data from RFIDs in this fast paced environment. Using computer software stored in the computer receiving identification data from the reader 21, the system continuously tracks each received RFID response to the above-noted sequential inventory requests. The software continuously adjusts the order for requested responses to formulate an alternate sequential order for an inventory request, to be employed for inventory requests subsequent to a detected data collision and to be transmitted by the reader 21 to RFIDs to identify themselves.

In this fashion, after each car is detected by the broadcast information from its RFID, that individual RFID identification is placed on a sequential list of RFID identifiers held in memory of the computer being communicated RFID information. The memorized and continually changing list holds cars that have been detected in order from earliest to latest. In a typical four car race, the normally transmitted inventory request list transmitted to the RFIDs would sequence initially as ID1, ID2, ID3, ID4. This works fine in the single time slot as long as no data collision is detected. In the received responses, when the specific RFID identifier of each responder is detected, as for example, ID2, the alternate inventory list held in computer memory is re-sequenced ID1, ID3, ID4, ID2, thereby placing the inventory request for ID2, the last sensed RFID, at the end of the alternated ordered inventory request list.

When a collision of data is detected as shown where N is more than zero on FIG. 4, even using the first means to avoid such a problem noted above, the system imitates the second means to avoid data collisions and data loss and will change the normally transmitted inventory request for responses, (where only the transponder with the matching ID can respond) to the alternate ordered list which is being constantly updated to place the latest sensed RFID identifier ID, at the end of the list (last in the inventory request).

Employing this second means to avoid data collisions, inventory request broadcasts are made in the order of the alternate ordered inventory request until the IDs are resolved, which is signified by no collision of identification data received. So, in this example of the alternate ordered request, the RFID identified as ID1 is sent an addressed inventory request since it is the most likely car to cross the antenna next, followed by ID3 and ID4. The substitute list can go through the entire list or just part of the list until one RFID responds. Once a response is received from one of the RFIDs signifying no data collision, the system breaks out of the collision algorithm and goes back to the normal sequential un-addressed inventory request. Other variants of this algorithm, where the latest RFID to have responded is placed last on an ordered inventory request for response, are of course possible and will occur to those skilled in the art as a means to acquire RFIDs after a data collision in the fast paced racing environment, and such are anticipated. However, the noted method of changing the order of the inventory request to place the latest responding RFID last on the alternate ordered inventory request and continually updating this alternate ordered inventory request for use after any data collision is the current best mode of the system and is preferred.

Finally, as also noted earlier and shown on FIG. 4, the responses to broadcast inventory requests of participants in the race yields their individual identification information. This information can also be used to actually register the participants in the race without the need to pre-register their inclusion in the race. This is accomplished by either receiving and indexing the broadcast identification information from the RFID tag specific to each participant or comparing the identification information to stored information related to that specific RFID tag which was collected when the RFID tag was assigned to them. Either way, this step would help speed up the holding of races since the RFID tag is used to eliminate the tedious step of registering for the race.

While all of the fundamental characteristics and features of the present invention have been described herein, with reference to particular embodiments thereof a latitude of modifications, various changes and substitutions are intended in the foregoing disclosure, and it will be apparent that in some instances some features of the invention will be employed without a corresponding use of other features without departing from the scope of the invention as set forth. It should be understood that such substitutions, modifications, and variations may be made by those skilled in the art without departing from the spirit or scope of the invention. Consequently, all such modifications and variations are included within the scope of the invention.

What is claimed is:

1. A method for tracking a plurality of participants in a race wherein each participant has an RFID tag attached which broadcasts identifying information specific to that participant in response to an inventory request broadcast, received by the RFID at a monitoring point on a track, comprising the steps of:

assigning RFIDs which transmit identification information specific to individual participants in a race, subsequent to a first sequentially ordered inventory request received by said RFIDs;

storing said identification information for each of said individual participants in a data storage means;

broadcasting said inventory request to said individual participants in proximity to a monitored point on a race track, to thereby elicit a response broadcast of said identification information from any of said individual participants identified in said inventory request and within said proximity to said monitored point;

monitoring transmitted identification information contained in each said response broadcast to ascertain in order which of said plurality of participants has responded to said inventory request;

storing respective said identification information for each responding participant in a data storage means;

employing a first means to prevent data collisions caused by substantially simultaneous transmission of said identification information by said responding participants; and continually updating said identification information stored in said data storage means to determine the most recent response identifying a most recent responding participant from said responding participants; and employing computer software resident on a computing device to monitor said identification information in said data storage means to determine a leader in said race.

2. A method for tracking a plurality of participants in a race of claim 1 additionally comprising the steps of:

employing a second means to prevent data collisions caused by substantially simultaneous transmission of said identification information by said responding participants, should said data collision be detected.

3. The method for tracking a plurality of participants in a race of claim 1 wherein said employing a first means to prevent data collisions caused by substantially simultaneous transmission of said identification information by said responding participants includes the step of:

broadcasting a command to cease responding to at least one subsequent said inventory request broadcast to each specific participant responding to said inventory request with their said identification information.

4. The method for tracking a plurality of participants in a race of claim 2 wherein said employing a second means to prevent data collisions caused by substantially simultaneous transmission of said identification information by said responding participants includes the step of:

monitoring said response broadcasts to determine presence of a data collision;

sequentially ordering said inventory request, subsequent to said data collision, to elicit responses from said plurality of participants in a determined order forming a second sequentially ordered inventory request; and placing said most recent responding participant last in said determined order.

5. The method for tracking a plurality of participants in a race of claim 3 wherein said employing a second means to prevent data collisions caused by substantially simultaneous transmission of said identification information by said responding participants includes the step of:

monitoring said response broadcasts to determine presence of a data collision;

sequentially ordering said inventory request, subsequent to said data collision, to elicit responses from said plurality of participants in a determined order forming a second sequentially ordered inventory request; and placing said most recent responding participant, last, in said determined order.

6. The method for tracking a plurality of participants in a race of claim 4 comprising the additional steps of:

monitoring said response broadcasts to determine cessation of the presence of said data collision; and returning to said first sequentially ordered inventory request.

7. The method for tracking a plurality of participants in a race of claim 5 comprising the additional steps of:

monitoring said response broadcasts to determine cessation of the presence of said data collision; and returning to said first sequentially ordered inventory request.

8. The method for tracking a plurality of participants in a race of claim 5 wherein said monitoring said response broadcasts to determine presence of a data collision includes the steps of:

employing computer resident software to monitor said response broadcasts recieved during each response time period; and including instructions in said computer resident software to determine a data collision when during any single time slot allotted for said response broadcasts, unintelligible data is received in said response broadcasts indicating a data collision.

9. The method for tracking a plurality of participants in a race of claim 1 additionally including the steps of:

instructing said individual participants in said race, in said inventory request, to respond in a single time period.

10. The method for tracking a plurality of participants in a race of claim 2 additionally including the steps of:

instructing said individual participants in said race, in said inventory request, to respond in a single time period.

11. The method for tracking a plurality of participants in a race of claim 3 additionally including the steps of:

instructing said individual participants in said race, in said inventory request, to respond in a single time period.

12. The method for tracking a plurality of participants in a race of claim 4 additionally including the steps of:

instructing said individual participants in said race, in said inventory request, to respond in a single time period.

13. The method for tracking a plurality of participants in a race of claim 5 additionally including the steps of:

instructing said individual participants in said race, in said inventory request, to respond in a single time period.

14. The method for tracking a plurality of participants in a race of claim 6 additionally including the steps of:

instructing said individual participants in said race, in said inventory request, to respond in a single time period.

15. The method for tracking a plurality of participants in a race of claim 7 additionally including the steps of:

instructing said individual participants in said race, in said inventory request, to respond in a single time period.

16. The method for tracking a plurality of participants in a race of claim 8 additionally including the steps of:

instructing said individual participants in said race, in said inventory request, to respond in a single time period.

17. The method for tracking a plurality of participants in a race of claim 1 additionally including the steps of:

employing said identification information from each of said individual participants, as a means to register said participants for said race thereby eliminating pre-registration.

18. The method for tracking a plurality of participants in a race of claim 2 additionally including the steps of:

employing said identification information from each of said individual participants, as a means to register said participants for said race thereby eliminating pre-registration.

19. The method for tracking a plurality of participants in a race of claim 3 additionally including the steps of:

employing said identification information from each of said individual participants, as a means to register said participants for said race thereby eliminating pre-registration.

20. The method for tracking a plurality of participants in a race of claim 4 additionally including the steps of:

employing said identification information from each of said individual participants, as a means to register said participants for said race thereby eliminating pre-registration.

21. The method for tracking a plurality of participants in a race of claim 5 additionally including the steps of:

employing said identification information from each of said individual participants, as a means to register said participants for said race thereby eliminating pre-registration.

22. A system for automatically tracking each individual participant of a plurality of participants in a race around a track, comprising:

means for electronic storage of information, said information associated with the identity of said participant, said means for electronic storage engaged on said participant;

means for RF transmission of said information engaged on said participant;

means for activation of said means for RF transmission by transmitting a first inventory request to thereby elicit a response in the form of said information identifying from any said responding participant;

means for receipt of said information contained in said RF transmission from said responding participant;

a computer communicating with said means for receipt of said information;

software resident in said computer, said software providing a means to track the progress of each of said individual participants in said plurality of participants in a race and determine a leader, based on said information received by said means for receipt of said information; and first means to prevent data collisions caused by substantially simultaneous RF transmissions of said identification information by said responding participants.

23. The system for automatically tracking each individual participant of a plurality of participants in a race around a track, of claim 22 wherein said first means to prevent data collisions comprises:

said means for activation of said means for RF transmission broadcasting a command to cease responding to at least one subsequent said inventory request broadcast to each specific participant responding to said inventory request with their said identification information.

24. The system for automatically tracking each individual participant of a plurality of participants in a race around a track of claim 20 additionally comprising:

said means for receipt of said information contained in said RF transmission from said responding participant also monitoring said RF transmission for unintelligible data thereby determining a data collision caused by RF transmission from a plurality of said responding participants;

said software resident in said computer continually updating said identification information and storing in a data storage means to the most recent response identifying a most recent responding participant, from said responding participants; and said software resident in said computer reordering said first inventory request, subsequent to any said data collision, to elicit responses from said plurality of participants in a determined order of a second sequentially ordered inventory request; and said software resident in said computer thereby placing said most recent responding participant, last, in said determined order.

25. The system for automatically tracking each individual participant of a plurality of participants in a race around a track of claim 23 additionally comprising:

said means for receipt of said information contained in said RF transmission from said responding participant also monitoring said RF transmission for unintelligible data thereby determining a data collision caused by RF transmission from a plurality of said responding participants;

said software resident in said computer continually updating said identification information and storing in a data storage means to the most recent response identifying a most recent responding participant, from said responding participants; and said software resident in said computer reordering said first inventory request, subsequent to any said data collision, to elicit responses from said plurality of participants in a determined order of a second sequentially ordered inventory request; and said software resident in said computer thereby placing said most recent responding participant last, in said determined order.

* * * * *